US011721296B2

(12) United States Patent
Crounse

(10) Patent No.: US 11,721,296 B2
(45) Date of Patent: Aug. 8, 2023

(54) METHOD AND APPARATUS FOR RENDERING COLOR IMAGES

(71) Applicant: E Ink Corporation, Billerica, MA (US)

(72) Inventor: Kenneth R. Crounse, Somerville, MA (US)

(73) Assignee: E Ink Corporation, Billerica, MA (US)

( * ) Notice: Subject to any disclaimer, the term of this patent is extended or adjusted under 35 U.S.C. 154(b) by 19 days.

(21) Appl. No.: 17/516,795

(22) Filed: Nov. 2, 2021

(65) Prior Publication Data

US 2022/0139341 A1 May 5, 2022

Related U.S. Application Data

(60) Provisional application No. 63/108,855, filed on Nov. 2, 2020.

(51) Int. Cl.
*G09G 3/34* (2006.01)
*G09G 3/38* (2006.01)

(52) U.S. Cl.
CPC ..... *G09G 3/344* (2013.01); *G09G 3/38* (2013.01); *G09G 2320/0666* (2013.01); *G09G 2340/06* (2013.01)

(58) Field of Classification Search
CPC .. G09G 3/344; G09G 3/38; G09G 2320/0666; G09G 2340/06; G09G 3/2044; G09G 5/02
See application file for complete search history.

(56) References Cited

U.S. PATENT DOCUMENTS

| | | | |
|---|---|---|---|
| 5,930,026 | A | 7/1999 | Jacobson |
| 6,017,584 | A | 1/2000 | Albert et al. |
| 6,445,489 | B1 | 9/2002 | Jacobson et al. |
| 6,504,524 | B1 | 1/2003 | Gates et al. |
| 6,512,354 | B2 | 1/2003 | Jacobson et al. |
| 6,531,997 | B1 | 3/2003 | Gates et al. |
| 6,545,797 | B2 | 4/2003 | Chen et al. |
| 6,664,944 | B1 | 12/2003 | Albert et al. |
| 6,753,999 | B2 | 6/2004 | Zehner et al. |
| 6,788,452 | B2 | 9/2004 | Liang et al. |
| 6,825,970 | B2 | 11/2004 | Goenaga et al. |
| 6,900,851 | B2 | 5/2005 | Morrison et al. |
| 6,995,550 | B2 | 2/2006 | Jacobson et al. |
| 7,012,600 | B2 | 3/2006 | Zehner et al. |
| 7,023,420 | B2 | 4/2006 | Comiskey et al. |
| 7,034,783 | B2 | 4/2006 | Gates et al. |
| 7,038,656 | B2 | 5/2006 | Liang et al. |

(Continued)

OTHER PUBLICATIONS

Korean Intellectual Property Office, "International Search Report and Written Opinion", PCT/US2021/057648, dated Feb. 16, 2022.

(Continued)

*Primary Examiner* — Mark W Regn
(74) *Attorney, Agent, or Firm* — Brian D. Bean

(57) ABSTRACT

There are provided methods for driving an electro-optic display A method for driving an electro-optic display having a plurality of display pixels, the method comprises receiving an input image, processing the input image to create color separation cumulate, and using a threshold array to process the color separation cumulate to generate colors for the electro-optic display.

13 Claims, 10 Drawing Sheets
(8 of 10 Drawing Sheet(s) Filed in Color)

(56) References Cited

U.S. PATENT DOCUMENTS 7,038,670 B2 5/2006 Liang et al.
7,046,228 B2 5/2006 Liang et al.
7,052,571 B2 5/2006 Wang et al.
7,054,038 B1 5/2006 Ostromoukhov et al.
7,061,166 B2 6/2006 Kuniyasu
7,061,662 B2 6/2006 Chung et al.
7,075,502 B1 7/2006 Drzaic et al.
7,116,466 B2 10/2006 Whitesides et al.
7,119,772 B2 10/2006 Amundson et al.
7,167,155 B1 1/2007 Albert et al.
7,177,066 B2 2/2007 Chung et al.
7,193,625 B2 3/2007 Danner et al.
7,202,847 B2 4/2007 Gates
7,259,744 B2 8/2007 Arango et al.
7,327,511 B2 2/2008 Whitesides et al.
7,385,751 B2 6/2008 Chen et al.
7,408,699 B2 8/2008 Wang et al.
7,453,445 B2 11/2008 Amundson
7,492,339 B2 2/2009 Amundson
7,492,505 B2 2/2009 Liang et al.
7,528,822 B2 5/2009 Amundson et al.
7,583,251 B2 9/2009 Arango et al.
7,602,374 B2 10/2009 Zehner et al.
7,612,760 B2 11/2009 Kawai
7,667,684 B2 2/2010 Jacobson et al.
7,679,599 B2 3/2010 Kawai
7,683,606 B2 3/2010 Kang et al.
7,729,039 B2 6/2010 LeCain et al.
7,787,169 B2 8/2010 Abramson et al.
7,800,813 B2 9/2010 Wu et al.
7,839,564 B2 11/2010 Whitesides et al.
7,859,742 B1 12/2010 Chiu et al.
7,910,175 B2 3/2011 Webber
7,952,557 B2 5/2011 Amundson
7,952,790 B2 5/2011 Honeyman et al.
7,982,479 B2 7/2011 Wang et al.
7,982,941 B2 7/2011 Lin et al.
7,999,787 B2 8/2011 Amundson et al.
8,040,594 B2 10/2011 Paolini, Jr. et al.
8,054,526 B2 11/2011 Bouchard
8,077,141 B2 12/2011 Duthaler et al.
8,098,418 B2 1/2012 Paolini, Jr. et al.
8,125,501 B2 2/2012 Amundson et al.
8,139,050 B2 3/2012 Jacobson et al.
8,159,636 B2 4/2012 Sun et al.
8,174,490 B2 5/2012 Whitesides et al.
8,243,013 B1 8/2012 Sprague et al.
8,274,472 B1 9/2012 Wang et al.
8,289,250 B2 10/2012 Zehner et al.
8,300,006 B2 10/2012 Zhou et al.
8,314,784 B2 11/2012 Ohkami et al.
8,363,299 B2 1/2013 Paolini, Jr. et al.
8,373,649 B2 2/2013 Low et al.
8,384,658 B2 2/2013 Albert et al.
8,422,116 B2 4/2013 Sprague et al.
8,456,414 B2 6/2013 Lin et al.
8,462,102 B2 6/2013 Wong et al.
8,503,063 B2 8/2013 Sprague
8,514,168 B2 8/2013 Chung et al.
8,537,105 B2 9/2013 Chiu et al.
8,558,783 B2 10/2013 Wilcox et al.
8,558,786 B2 10/2013 Lin
8,558,855 B2 10/2013 Sprague et al.
8,576,164 B2 11/2013 Sprague et al.
8,576,259 B2 11/2013 Lin et al.
8,576,470 B2 11/2013 Paolini, Jr. et al.
8,576,475 B2 11/2013 Huang et al.
8,605,032 B2 12/2013 Liu et al.
8,605,354 B2 12/2013 Zhang et al.
8,649,084 B2 2/2014 Wang et al.
8,665,206 B2 3/2014 Lin et al.
8,670,174 B2 3/2014 Sprague et al.
8,681,191 B2 3/2014 Yang et al.
8,704,756 B2 4/2014 Lin
8,717,664 B2 5/2014 Wang et al.
8,750,390 B2 6/2014 Sun et al.
8,786,935 B2 7/2014 Sprague
8,797,634 B2 8/2014 Paolini, Jr. et al.
8,810,525 B2 8/2014 Sprague
8,873,129 B2 10/2014 Paolini, Jr. et al.
8,902,153 B2 12/2014 Bouchard et al.
8,902,491 B2 12/2014 Wang et al.
8,917,439 B2 12/2014 Wang et al.
8,928,562 B2 1/2015 Gates et al.
8,928,641 B2 1/2015 Chiu et al.
8,941,885 B2 1/2015 Nishikawa et al.
8,964,282 B2 2/2015 Wang et al.
8,976,444 B2 3/2015 Zhang et al.
9,013,394 B2 4/2015 Lin
9,013,783 B2 4/2015 Sprague
9,019,197 B2 4/2015 Lin
9,019,198 B2 4/2015 Lin et al.
9,019,318 B2 4/2015 Sprague et al.
9,082,352 B2 7/2015 Cheng et al.
9,116,412 B2 8/2015 Lin
9,146,439 B2 9/2015 Zhang
9,171,508 B2 10/2015 Sprague et al.
9,182,646 B2 11/2015 Paolini, Jr. et al.
9,195,111 B2 11/2015 Anseth et al.
9,199,441 B2 12/2015 Danner
9,218,773 B2 12/2015 Sun et al.
9,224,338 B2 12/2015 Chan et al.
9,224,342 B2 12/2015 Sprague et al.
9,224,344 B2 12/2015 Chung et al.
9,230,492 B2 1/2016 Harrington et al.
9,251,736 B2 2/2016 Lin et al.
9,262,973 B2 2/2016 Wu et al.
9,285,649 B2 3/2016 Du et al.
9,299,294 B2 3/2016 Lin et al.
9,341,916 B2 5/2016 Telfer et al.
9,360,733 B2 6/2016 Wang et al.
9,361,836 B1 6/2016 Telfer et al.
9,390,066 B2 7/2016 Smith et al.
9,390,661 B2 7/2016 Chiu et al.
9,423,666 B2 8/2016 Wang et al.
9,459,510 B2 10/2016 Lin
9,460,666 B2 10/2016 Sprague et al.
9,495,918 B2 11/2016 Harrington et al.
9,501,981 B2 11/2016 Lin et al.
9,513,527 B2 12/2016 Chan et al.
9,513,743 B2 12/2016 Sjodin et al.
9,514,667 B2 12/2016 Lin
9,541,814 B2 1/2017 Lin et al.
9,612,502 B2 4/2017 Danner et al.
9,613,587 B2 4/2017 Halfman et al.
9,620,048 B2 4/2017 Sim et al.
9,671,668 B2 6/2017 Chan et al.
9,672,766 B2 6/2017 Sjodin
9,691,333 B2 6/2017 Cheng et al.
9,721,495 B2 8/2017 Harrington et al.
9,759,980 B2 9/2017 Du et al.
9,792,861 B2 10/2017 Chang et al.
9,792,862 B2 10/2017 Hung et al.
9,812,073 B2 11/2017 Lin et al.
10,027,963 B2 7/2018 Su et al.
10,162,242 B2 12/2018 Wang et al.
10,209,556 B2 2/2019 Rosenfeld et al.
10,229,641 B2 3/2019 Yang et al.
10,319,313 B2 6/2019 Harris et al.
10,339,876 B2 7/2019 Lin et al.
10,467,984 B2 11/2019 Buckley et al.
10,672,350 B2 6/2020 Amundson et al.
11,151,951 B2 10/2021 Lin et al.
2003/0102858 A1 6/2003 Jacobson et al.
2004/0246562 A1 12/2004 Chung et al.
2005/0253777 A1 11/2005 Zehner et al.
2007/0103427 A1 5/2007 Zhou et al.
2007/0176912 A1 8/2007 Beames et al.
2008/0024429 A1 1/2008 Zehner
2008/0024482 A1 1/2008 Gates et al.
2008/0043318 A1 2/2008 Whitesides et al.
2008/0136774 A1 6/2008 Harris et al.
2008/0303780 A1 12/2008 Sprague et al.
2009/0225398 A1 9/2009 Duthaler et al.

(56) References Cited

U.S. PATENT DOCUMENTS

| | | | |
|---|---|---|---|
| 2010/0156780 | A1 | 6/2010 | Jacobson et al. |
| 2010/0194733 | A1 | 8/2010 | Lin et al. |
| 2010/0194789 | A1 | 8/2010 | Lin et al. |
| 2010/0220121 | A1 | 9/2010 | Zehner et al. |
| 2010/0265561 | A1 | 10/2010 | Gates et al. |
| 2011/0043543 | A1 | 2/2011 | Chen et al. |
| 2011/0063314 | A1 | 3/2011 | Chiu et al. |
| 2011/0175875 | A1 | 7/2011 | Lin et al. |
| 2011/0221740 | A1 | 9/2011 | Yang et al. |
| 2012/0001957 | A1 | 1/2012 | Liu et al. |
| 2012/0098740 | A1 | 4/2012 | Chiu et al. |
| 2013/0046803 | A1 | 2/2013 | Parmar et al. |
| 2013/0063333 | A1 | 3/2013 | Arango et al. |
| 2013/0249782 | A1 | 9/2013 | Wu et al. |
| 2014/0055840 | A1 | 2/2014 | Zang et al. |
| 2014/0078576 | A1 | 3/2014 | Sprague |
| 2014/0204012 | A1 | 7/2014 | Wu et al. |
| 2014/0240210 | A1 | 8/2014 | Wu et al. |
| 2014/0253425 | A1 | 9/2014 | Zalesky et al. |
| 2014/0293398 | A1 | 10/2014 | Wang et al. |
| 2014/0362213 | A1 | 12/2014 | Tseng |
| 2015/0262255 | A1 | 9/2015 | Khajehnouri et al. |
| 2015/0268531 | A1 | 9/2015 | Wang et al. |
| 2015/0301246 | A1 | 10/2015 | Zang et al. |
| 2016/0180777 | A1 | 6/2016 | Lin et al. |
| 2019/0080666 | A1* | 3/2019 | Chappalli ..... G09G 3/006 |

OTHER PUBLICATIONS

Pappas, Thrasyvoulos N. "Model-based halftoning of color images." IEEE Transactions on image processing 6.7 (1997): 1014-24.

Ostromoukhov, Victor et al., "Multi-Color and Artistic Dithering", Proceedings of the 26th Annual Conference on Computer Graphics and Interactive Techniques, ACM Press / Addison-Wesley Publishing Co. (1999).

Ulichney, Robert A., "Void-and-Cluster Method for Dither Array Generation", Human Vision Visual Processing and Digital Display IV, vol. 1913, International Society for Optics and Photonics, (1993).

* cited by examiner

Source space dithering using Kuhn decomposition

R,G,B = 205, 49, 152

Source space dithering using Kuhn decomposition

METHOD AND APPARATUS FOR RENDERING COLOR IMAGES

REFERENCE TO RELATED APPLICATIONS

This application is related to and claims priority to U.S. Provisional Application 63/108,855 filed on Nov. 2, 2020.

The entire disclosures of the aforementioned application is herein incorporated by reference.

SUBJECT OF THE INVENTION

This invention relates to methods for driving electro-optic displays. More specifically, this invention relates to driving methods for dithering and rendering images on electrophoretic displays.

BACKGROUND

This invention relates to a method and apparatus for rendering color images. More specifically, this invention relates to a method for multi-color dithering, where a combination of color intensities are converted into a multi-color surface coverage.

The term "pixel" is used herein in its conventional meaning in the display art to mean the smallest unit of a display capable of generating all the colors which the display itself can show.

Half-toning has been used for many decades in the printing industry to represent gray tones by covering a varying proportion of each pixel of white paper with black ink. Similar half-toning schemes can be used with CMY or CMYK color printing systems, with the color channels being varied independently of each other.

However, there are many color systems in which the color channels cannot be varied independently of one another, in as much as each pixel can display any one of a limited set of primary colors (such systems may hereinafter be referred to as "limited palette displays" or "LPD's"); the ECD patent color displays are of this type. To create other colors, the primaries must be spatially dithered to produce the correct color sensation.

Electronic displays typically include an active matrix backplane, a master controller, local memory and a set of communication and interface ports. The master controller receives data via the communication/interface ports or retrieves it from the device memory. Once the data is in the master controller, it is translated into a set of instruction for the active matrix backplane. The active matrix backplane receives these instructions from the master controller and produces the image. In the case of a color device, on-device gamut computations may require a master controller with increased computational power. As indicated above, rendering methods for color electrophoretic displays are often computational intense, and although, as discussed in detail below, the present invention itself provides methods for reducing the computational load imposed by rendering, both the rendering (dithering) step and other steps of the overall rendering process may still impose major loads on device computational processing systems.

The increased computational power required for image rendering diminishes the advantages of electrophoretic displays in some applications. In particular, the cost of manufacturing the device increases, as does the device power consumption, when the master controller is configured to perform complicated rendering algorithms. Furthermore, the extra heat generated by the controller requires thermal management. Accordingly, at least in some cases, as for example when very high resolution images, or a large number of images need to be rendered in a short time, it may be desirable to have an efficient method for dithering multi-colored images.

SUMMARY OF INVENTION

Accordingly, in one aspect, the subject matter presented herein provides for a method for driving an electro-optic display, the method can include receiving an input image, processing the input image to create color separation cumulate, and dithering the input image by intersecting the color separation cumulate with a dither function.

In some embodiments, the dither function is a threshold array.

In another embodiment, the threshold array is a Blue Noise Mask (BNM).

In yet another embodiment, the step of processing is implemented by a look up table.

BRIEF DESCRIPTION OF DRAWINGS

The patent or application file contains at least one drawing executed in color. Copies of this patent or patent application publication with color drawing(s) will be provided by the Office upon request and payment of the necessary fee.

DETAILED DESCRIPTION

Figure 1:
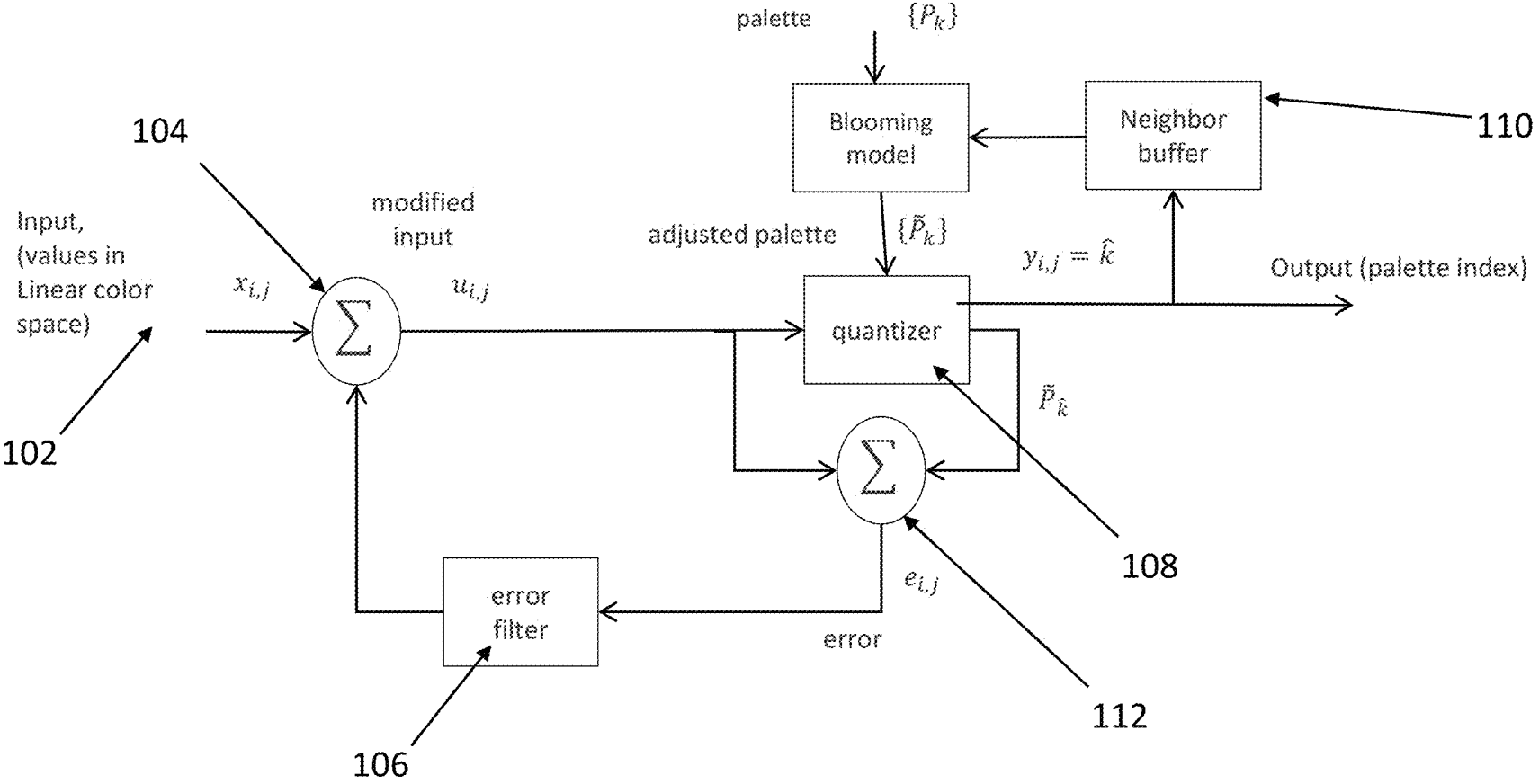
FIG. 1 of the accompanying drawings is an image rendering model in accordance with the subject matter presented herein.

Standard dithering algorithms such as error diffusion algorithms (in which the "error" introduced by printing one pixel in a particular color which differs from the color theoretically required at that pixel is distributed among neighboring pixels so that overall the correct color sensation is produced) can be employed with limited palette displays. There is an enormous literature on error diffusion; for a review see Pappas, Thrasyvoulos N. "Model-based halftoning of color images," IEEE Transactions on Image Processing 6.7 (1997): 1014-1024.

This application is also related to U.S. Pat. Nos. 5,930,026; 6,445,489; 6,504,524; 6,512,354; 6,531,997; 6,753,999; 6,825,970; 6,900,851; 6,995,550; 7,012,600; 7,023,420; 7,034,783; 7,061,166; 7,061,662; 7,116,466; 7,119,772; 7,177,066; 7,193,625; 7,202,847; 7,242,514; 7,259,744; 7,304,787; 7,312,794; 7,327,511; 7,408,699; 7,453,445; 7,492,339; 7,528,822; 7,545,358; 7,583,251; 7,602,374; 7,612,760; 7,679,599; 7,679,813; 7,683,606; 7,688, 297; 7,729,039; 7,733,311; 7,733,335; 7,787,169; 7,859,742; 7,952,557; 7,956,841; 7,982,479; 7,999,787; 8,077,141; 8,125,501; 8,139,050; 8,174,490; 8,243,013; 8,274,472; 8,289,250; 8,300,006; 8,305,341; 8,314,784; 8,373,649; 8,384,658; 8,456,414; 8,462,102; 8,514,168; 8,537,105; 8,558,783; 8,558,785; 8,558,786; 8,558,855; 8,576,164; 8,576,259; 8,593,396; 8,605,032; 8,643,595; 8,665,206; 8,681,191; 8,730,153; 8,810,525; 8,928,562; 8,928,641; 8,976,444; 9,013,394; 9,019,197; 9,019,198; 9,019,318; 9,082,352; 9,171,508; 9,218,773; 9,224,338; 9,224,342; 9,224,344; 9,230,492; 9,251,736; 9,262,973; 9,269,311; 9,299,294; 9,373,289; 9,390,066; 9,390,661; and 9,412,314; and U.S. Patent Applications Publication Nos. 2003/0102858; 2004/0246562; 2005/0253777; 2007/0091418; 2007/0103427; 2007/0176912; 2008/0024429; 2008/0024482; 2008/0136774; 2008/0291129; 2008/0303780; 2009/0174651; 2009/0195568; 2009/0322721; 2010/0194733; 2010/0194789; 2010/0220121; 2010/0265561; 2010/0283804; 2011/0063314; 2011/0175875; 2011/0193840; 2011/0193841; 2011/0199671; 2011/0221740; 2012/0001957; 2012/0098740; 2013/0063333; 2013/0194250; 2013/0249782; 2013/0321278; 2014/0009817; 2014/0085355; 2014/0204012; 2014/0218277; 2014/0240210; 2014/0240373; 2014/0253425; 2014/0292830; 2014/0293398; 2014/0333685; 2014/0340734; 2015/0070744; 2015/0097877; 2015/0109283; 2015/0213749; 2015/0213765; 2015/0221257; 2015/0262255; 2015/0262551; 2016/0071465; 2016/0078820; 2016/0093253; 2016/0140910; and 2016/0180777. These patents and applications may hereinafter for convenience collectively be referred to as the "MEDEOD" (MEthods for Driving Electro-Optic Displays) applications, and are incorporated herein in their entirety by reference.

ECD systems exhibit certain peculiarities that must be taken into account in designing dithering algorithms for use in such systems. Inter-pixel artifacts are a common feature in such systems. One type of artifact is caused by so-called "blooming"; in both monochrome and color systems, there is a tendency for the electric field generated by a pixel electrode to affect an area of the electro-optic medium wider than that of the pixel electrode itself so that, in effect, one pixel's optical state spreads out into parts of the areas of adjacent pixels. Another kind of crosstalk is experienced when driving adjacent pixels brings about a final optical state, in the area between the pixels that differs from that reached by either of the pixels themselves, this final optical state being caused by the averaged electric field experienced in the inter-pixel region. Similar effects are experienced in monochrome systems, but since such systems are one-dimensional in color space, the inter-pixel region usually displays a gray state intermediate the states of the two adjacent pixel, and such an intermediate gray state does not greatly affect the average reflectance of the region, or it can easily be modeled as an effective blooming. However, in a color display, the inter-pixel region can display colors not present in either adjacent pixel.

The aforementioned problems in color displays have serious consequences for the color gamut and the linearity of the color predicted by spatially dithering primaries. Consider using a spatially dithered pattern of saturated Red and Yellow from the primary palette of an ECD display to attempt to create a desired orange color. Without crosstalk, the combination required to create the orange color can be predicted perfectly in the far field by using linear additive color mixing laws. Since Red and Yellow are on the color gamut boundary, this predicted orange color should also be on the gamut boundary. However, if the aforementioned effects produce (say) a blueish band in the inter-pixel region between adjacent Red and Yellow pixels, the resulting color will be much more neutral than the predicted orange color. This results in a "dent" in the gamut boundary, or, to be more accurate since the boundary is actually three-dimensional, a scallop. Thus, not only does a naïve dithering approach fail to accurately predict the required dithering, but it may as in this case attempt to produce a color which is not available since it is outside the achievable color gamut.

It may desirable for one to be able to predict the achievable gamut by extensive measurement of patterns or advanced modeling. This may be not be feasible if the number of device primaries is large, or if the crosstalk errors are large compared to the errors introduced by quantizing pixels to a primary colors. The present invention provides a dithering method that incorporates a model of blooming/crosstalk errors such that the realized color on the display is closer to the predicted color. Furthermore, the method stabilizes the error diffusion in the case that the desired color falls outside the realizable gamut, since normally error diffusion will produce unbounded errors when dithering to colors outside the convex hull of the primaries.

In some embodiments the reproduction of images may be performed using an Error-Diffusion model illustrated in FIG. 1 of the accompanying drawings. The method illustrated in FIG. 1 begins at an input 102, where color values $x_{i,j}$ are fed to a processor 104, where they are added to the output of an error filter 106 to produce a modified input $u_{i,j}$, which may hereinafter be referred to as "error-modified input colors" or "EMIC". The modified inputs $u_{i,j}$ are fed to a Quantizer 108.

In some embodiments, processes utilizing model-based error diffusion can become unstable, because the input image is assumed to lie in the (theoretical) convex hull of the primaries (i.e. the color gamut), but the actual realizable gamut is likely smaller due to loss of gamut because of dot overlap. Therefore, the error diffusion algorithm may be trying to achieve colors which cannot actually be achieved in practice and the error continues to grow with each successive "correction". It has been suggested that this problem be contained by clipping or otherwise limiting the error, but this leads to other errors.

In practice, one solution would be to have a better, non-convex estimate of the achievable gamut when performing gamut mapping of the source image, so that the error diffusion algorithm can always achieve its target color. It may be possible to approximate this from the model itself, or determine it empirically. In some embodiments, the quantizer 108 examines the primaries for the effect that choosing each would have on the error, and the quantizer chooses the primary with the least (by some metric) error if chosen. However, the primaries fed to the quantizer 108 are not the natural primaries of the system, $\{P_k\}$, but are an adjusted set of primaries, $\{\tilde{P}_k\}$, which allow for the colors of at least some neighboring pixels, and their effect on the pixel being quantized by virtue of blooming or other inter-pixel interactions.

One embodiment of the above method may use a standard Floyd-Steinberg error filter and processes pixels in raster order. Assuming, as is conventional, that the display is treated top-to-bottom and left-to-right, it is logical to use the above and left cardinal neighbors of pixel being considered to compute blooming or other inter-pixel effects, since these two neighboring pixels have already been determined. In this way, all modeled errors caused by adjacent pixels are accounted for since the right and below neighbor crosstalk is accounted for when those neighbors are visited. If the model only considers the above and left neighbors, the adjusted set of primaries must be a function of the states of those neighbors and the primary under consideration. The simplest approach is to assume that the blooming model is additive, i.e. that the color shift due to the left neighbor and the color shift due to the above neighbor are independent and additive. In this case, there are only "N choose 2" (equal to N*(N−1)/2) model parameters (color shifts) that need to be determined. For N=64 or less, these can be estimated from colorimetric measurements of checkerboard patterns of all these possible primary pairs by subtracting the ideal mixing law value from the measurement.

To take a specific example, consider the case of a display having 32 primaries. If only the above and left neighbors are considered, for 32 primaries there are 496 possible adjacent sets of primaries for a given pixel. Since the model is linear, only these 496 color shifts need to be stored since the additive effect of both neighbors can be produced during run time without much overhead. So for example if the unadjusted primary set comprises (P1 . . . P32) and your current up, left neighbors are P4 and P7, the modified primaries ($\tilde{P}_1 \ldots \tilde{P}_{32}$), the adjusted primaries fed to the quantizer are given by:

$$\tilde{P}_1 = P_1 + dP_{(1,4)} + dP_{(1,7)};$$

$$\ldots\ldots$$

$$\tilde{P}_{32} = P_{32} + dP_{(32,4)} + dP_{(32,7)},$$

where $dP_{(i,j)}$ are the empirically determined values in the color shift table.

More complicated inter-pixel interaction models are of course possible, for example nonlinear models, models taking account of corner (diagonal) neighbor, or models using a non-causal neighborhood for which the color shift at each pixel is updated as more of its neighbors are known.

The quantizer 108 compares the adjusted inputs $u'_{i,j}$ with the adjusted primaries $\{\tilde{P}_k\}$ and outputs the most appropriate primary $y_{i,k}$ to an output. Any appropriate method of selecting the appropriate primary may be used, for example a minimum Euclidean distance quantizer in a linear RGB space; this has the advantage of requiring less computing power than some alternative methods.

The $y_{i,k}$ output values from the quantizer 108 may be fed not only to the output but also to a neighborhood buffer 110, where they are stored for use in generating adjusted primaries for later-processed pixels. The modified input $u_{i,j}$ values and the output $y_{i,j}$ values are both supplied to a processor 112, which calculates:

$$e_{i,j} = u_{i,j} - y_{i,j}$$

and passes this error signal on to the error filter 106 in the same way as described above with reference to FIG. 1.

However, in practice, error diffusion based methods may be slow for some applications because they are not easily parallelizable. Where the next pixel output cannot be completed until a previous pixel's output becomes available. Alternatively, masked based methods may be adopted because of their simplicity, where the output at each pixel depends only on that pixel's input and a value from a look-up-table (LUT), meaning, each output can be computed completely independently of others.

Figure 2:
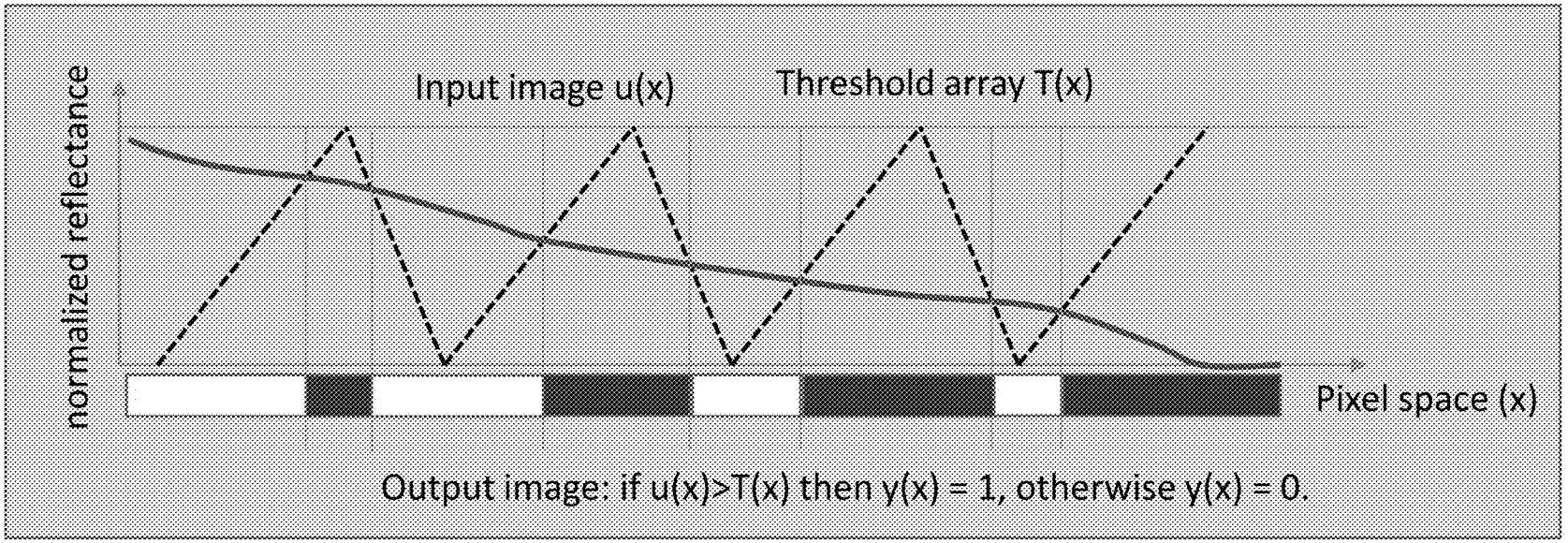
FIG. 2 is an exemplary black and white dithering method using masks in accordance with the subject matter presented herein.
Figure 3:
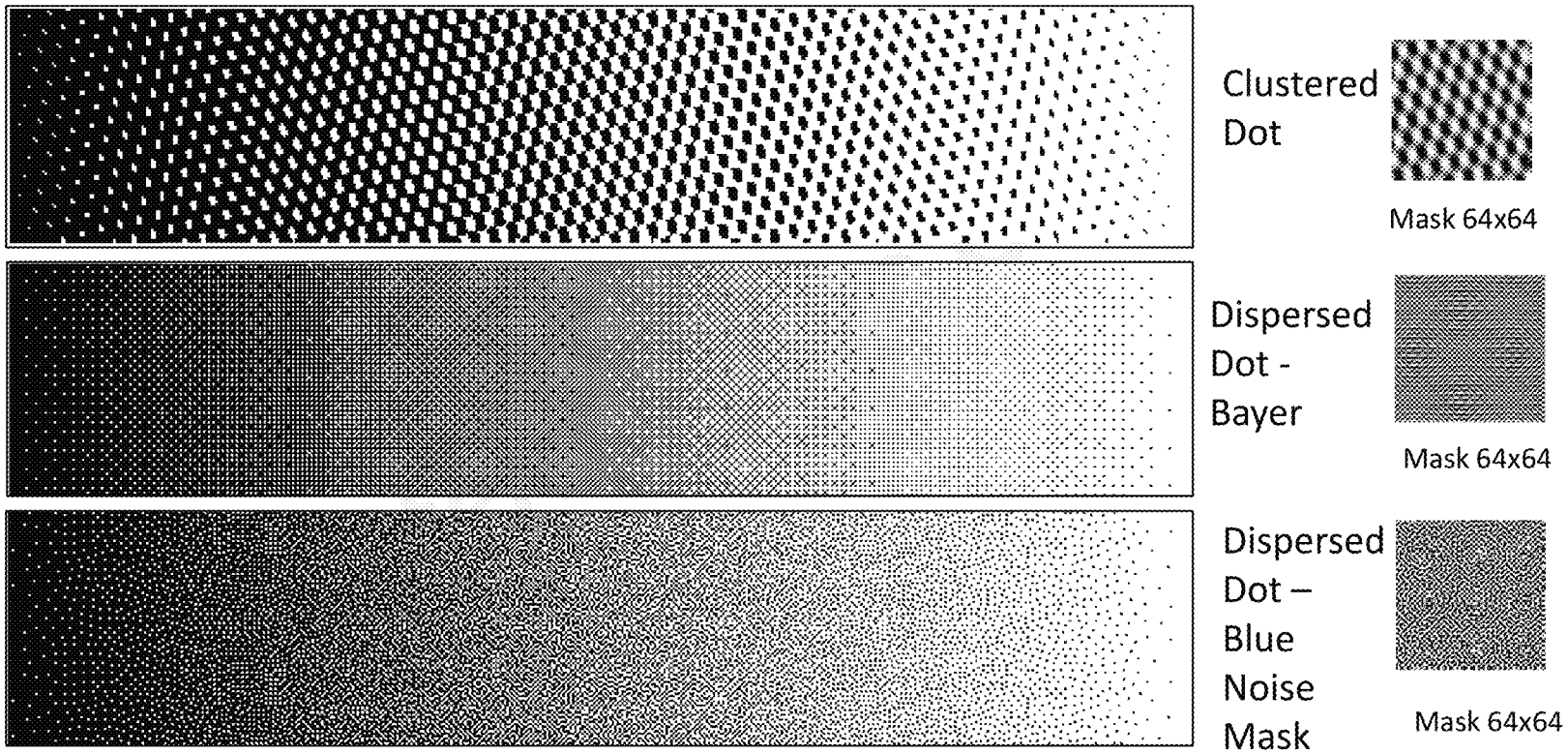
FIG. 3 illustrates various mask designs in accordance with the subject matter presented herein.

Referring now to FIG. 2, where an exemplary black and white dithering method is illustrated. As shown, an input grayscale image with normalized darkness values between 0 (white) and 1 (black) is dithered by comparing at each output location corresponding input darkness and dither threshold values. For example, if the darkness u(x) of an input image is higher than the dither threshold value T(x), then the output location is marked as black (i.e., 1), else it is marked as white (i.e., 0). FIG. 3 illustrates some mask designs in accordance with the subject matter disclosed herein.

Figure 4:
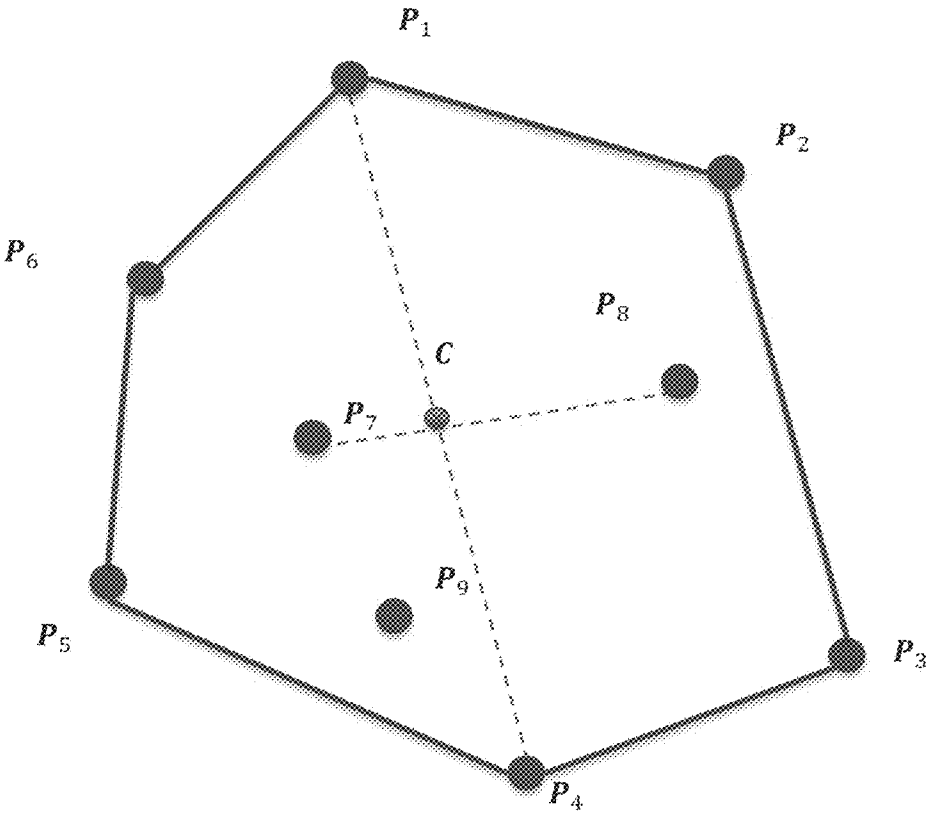
FIG. 4 illustrates a gamut color mapping in accordance with the subject matter disclosed herein.

In practice, when practicing multi-color dithering, it is assumed that the input colors to a dithering algorithm can be represented as a linear combination of multi-primaries. This may be achieved by dithering in the source space using gamut corners, or by gamut mapping the input to the device space color gamut. FIG. 4 illustrates one method of creating a color separation using a set of weights Px. Where each color C is defined as—

$$C = \sum_{i=1,\ldots N} \alpha_i(C) P_i \quad 0 \le \alpha_i \le 1, \sum \alpha_i = 1$$

Where the partial sums of these weights is referred to as separation cumulate $\Lambda_k(C)$, where $$\Lambda_k(C) = \sum_{i=1,\ldots k} \alpha_i(C)$$

Figure 5:
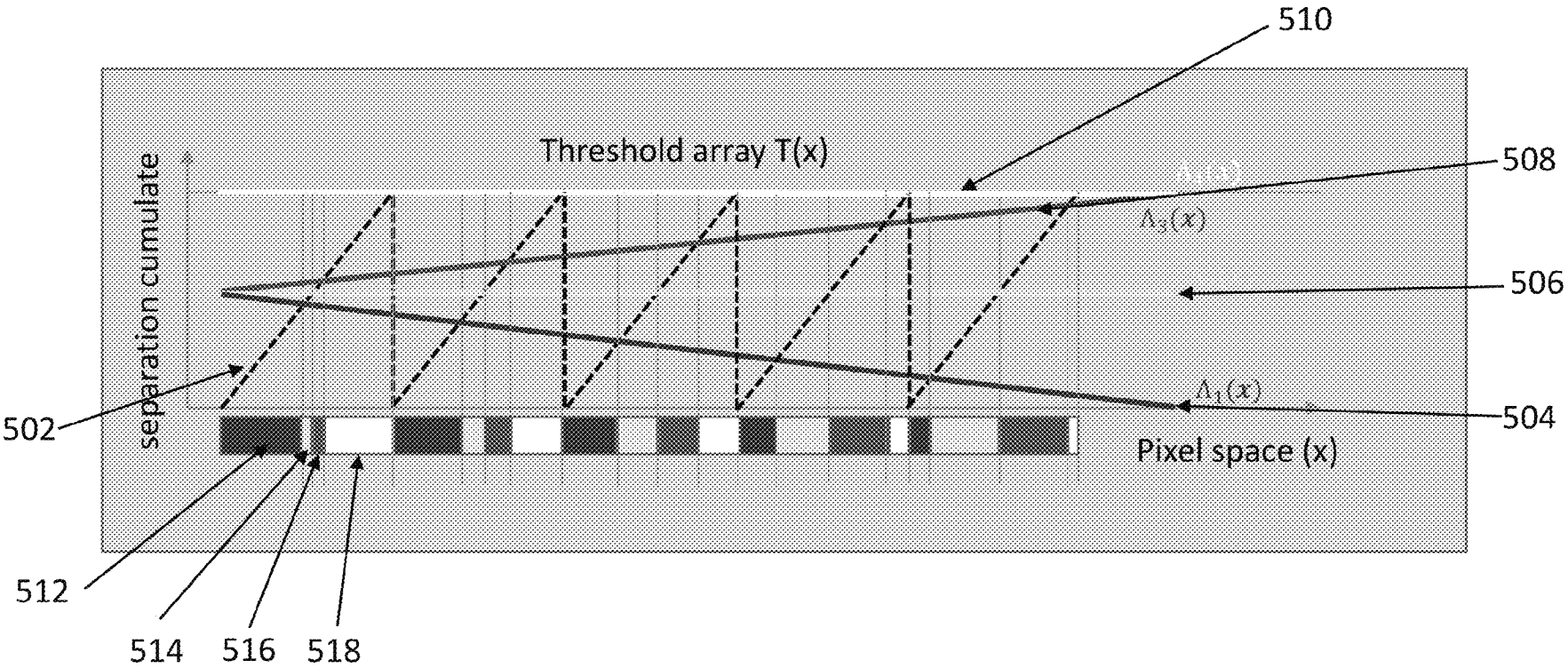
FIG. 5 illustrates a multi-color dithering method using masks in accordance with the subject matter disclosed herein.

In practice, dithering to multiple colors consists in intersecting the relative cumulative amounts of colors with a dither function (e.g., threshold array T(x) 502 of FIG. 5). Referring now to FIG. 5, illustrated here as an example is a method to print with 4 different colors inks $C_1$ 512, $C_2$ 514, $C_3$ 516 and $C_4$ 518. At each pixel of the output pixmap, the color separation gives the relative percentages of each of the basic colors, for example $d_1$ of color $C_1$ 512, $d_2$ of color $C_2$ 514, $d_3$ of color $C_3$ 516, and $d_4$ of color $C_4$ 518. Where one of the colors, for example $C_4$ 518, may be white.

Extending dithering to multiple colors consists in intersecting the relative cumulative amounts of colors $\Lambda_1(x)$ 504=d1, $\Lambda_2(x)$ 506=d1+d2, $\Lambda_3(x)$ 508=d1+d2+d3, and $\Lambda_4(x)$ 510=d1+d2+d3+d4 with a threshold array T(x), as illustrated in FIG. 5. Illustrated in FIG. 5 is a dithering example for the purpose of explaining the subject matter presented herein. In the interval where $\Lambda_1(x)$ 504>T(x) 502, the output location or pixel region will be printed with basic color $C_1$ 512 (e.g., black); in the interval where $\Lambda_2(x)$ 506>T(x) 502, the output location or pixel region will display color $C_2$ 514 (e.g., yellow); in the interval where $\Lambda_3(x)$ 508>T(x) 502, the output location or pixel region will display color $C_3$ 516 (e.g., red); and in the remaining interval where $\Lambda_4(x)$ 510>T(x) 502 and $\Lambda_3(x)$ 508≤T(x) 502, the output location or pixel region will display color $C_4$ 518 (e.g., white). As such, multi-color dithering as presented herein will convert the relative amounts of $d_1$, $d_2$, $d_3$, $d_4$ of colors $C_1$ 512, $C_2$ 514, $C_3$ 516 and $C_4$ 518 into relative coverage percentages and ensures by construction that the contributing colors are printed side by side.

Figure 6:
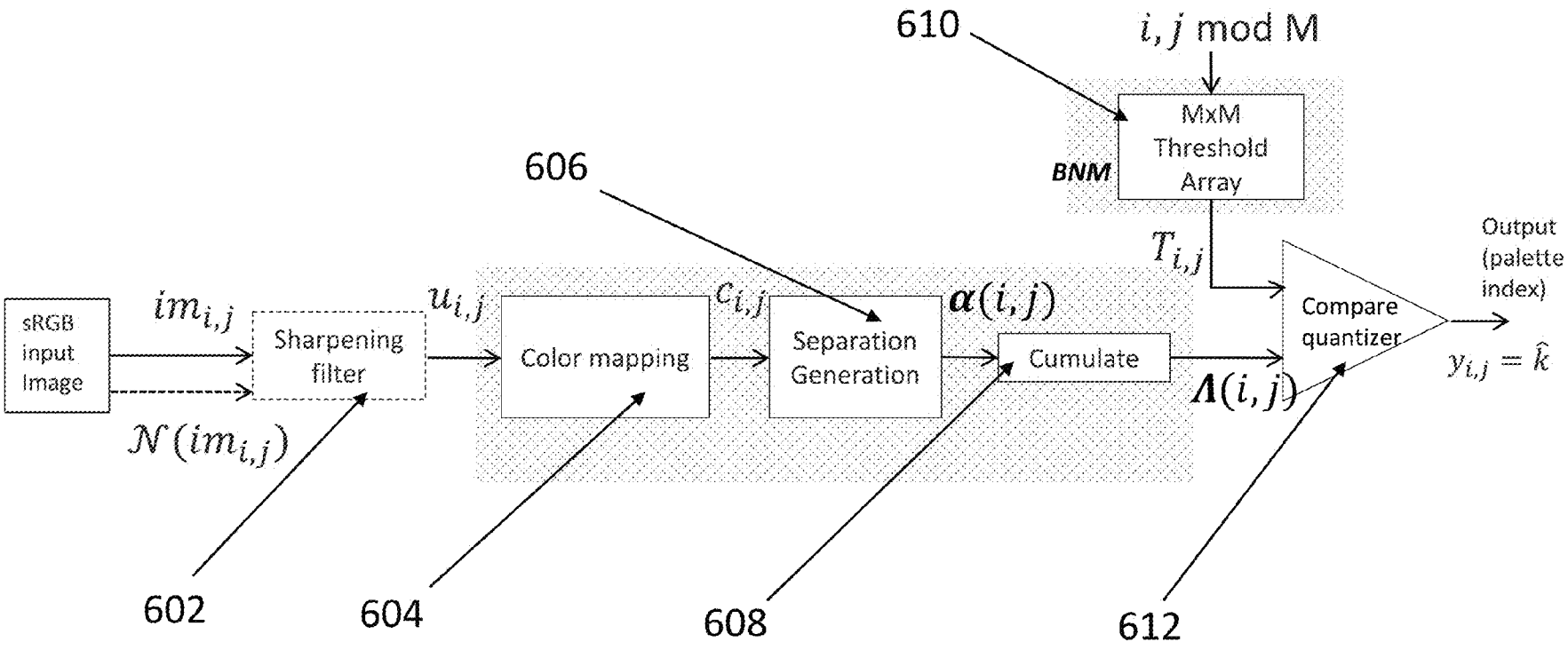
FIG. 6 illustrates a multi-color dithering algorithm using masks in accordance with the subject matter disclosed herein.
Figure 7:
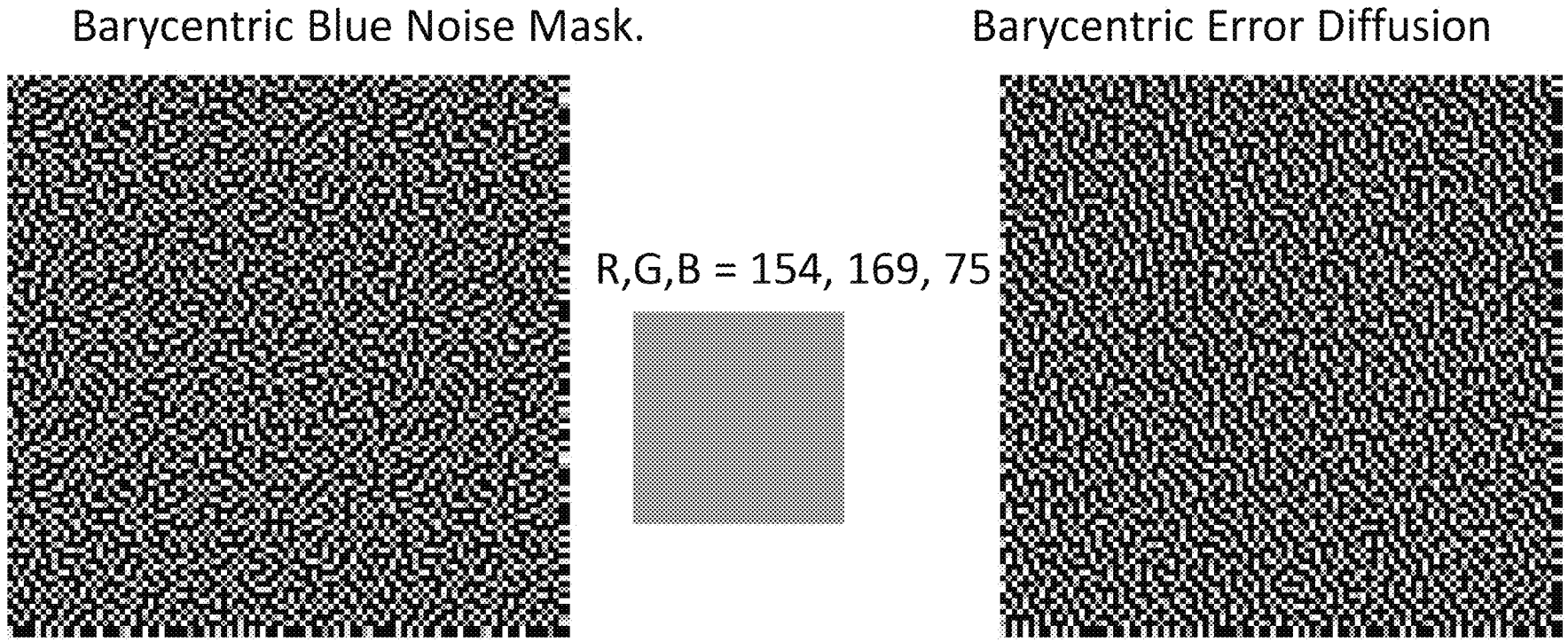
FIGS. 7-10 are various mask designs for multi-color dithering in accordance with the subject matter presented herein.
Figure 8:
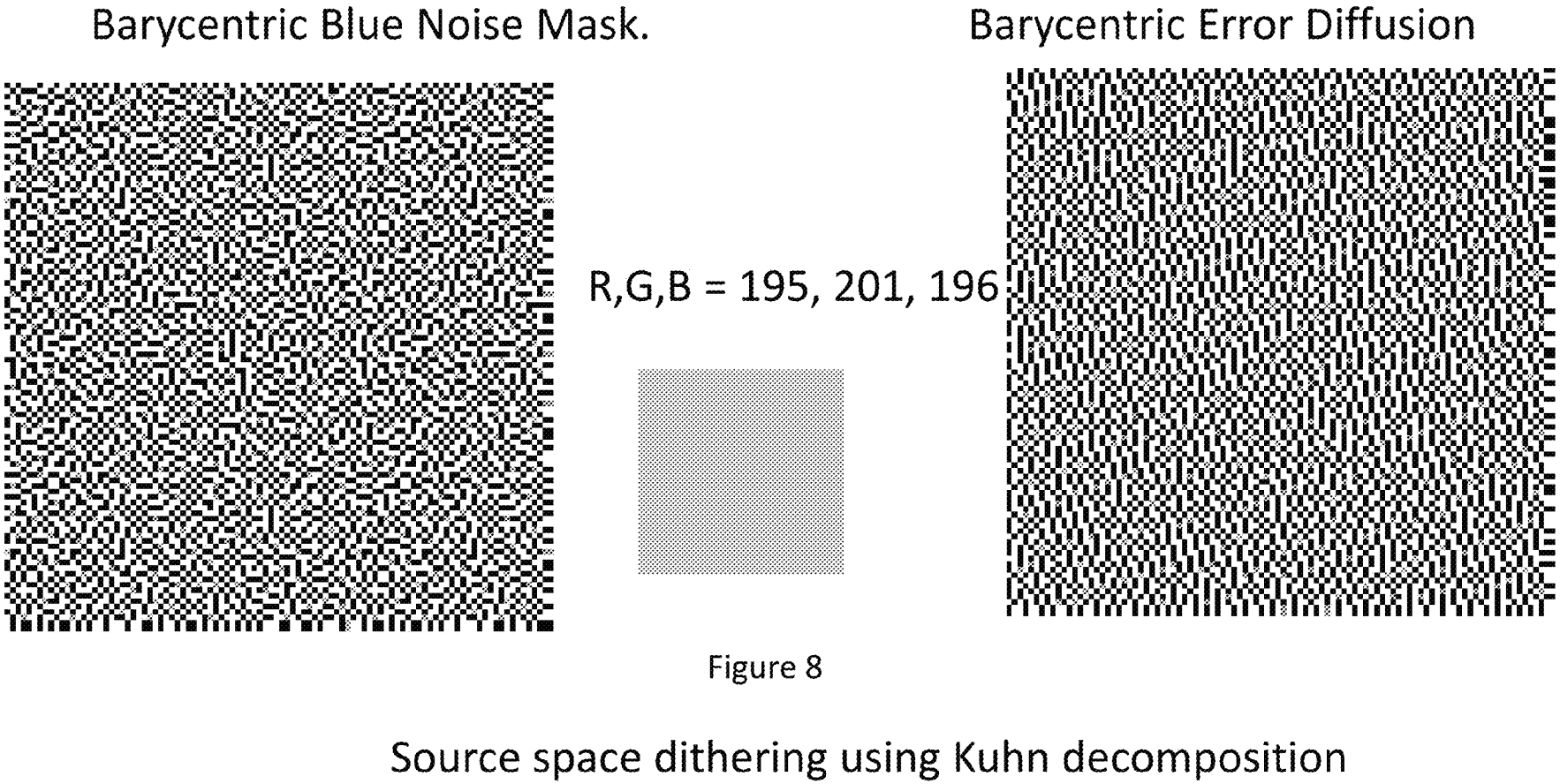
Figure 9:
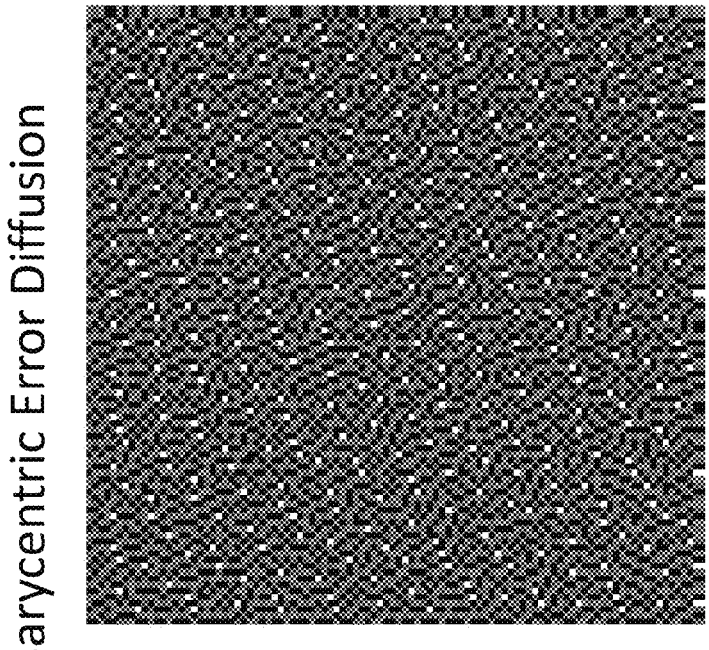
Figure 9:
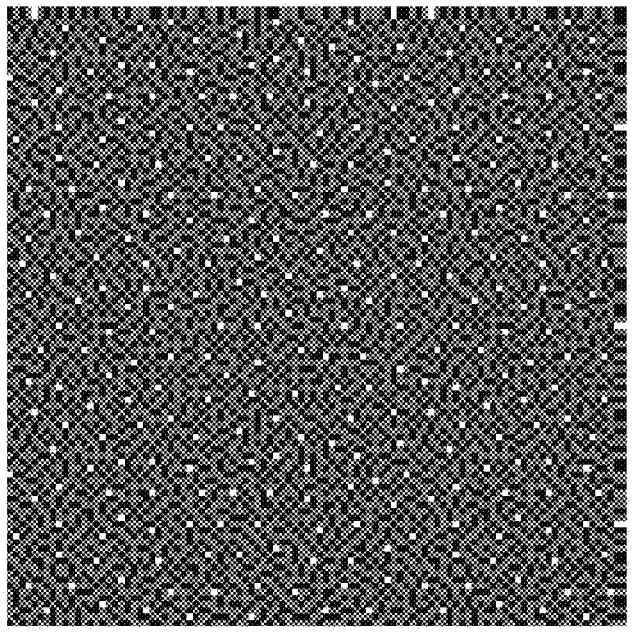
Figure 9:
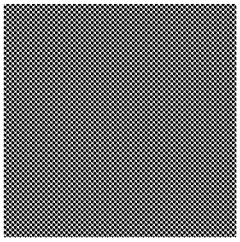
Figure 10:
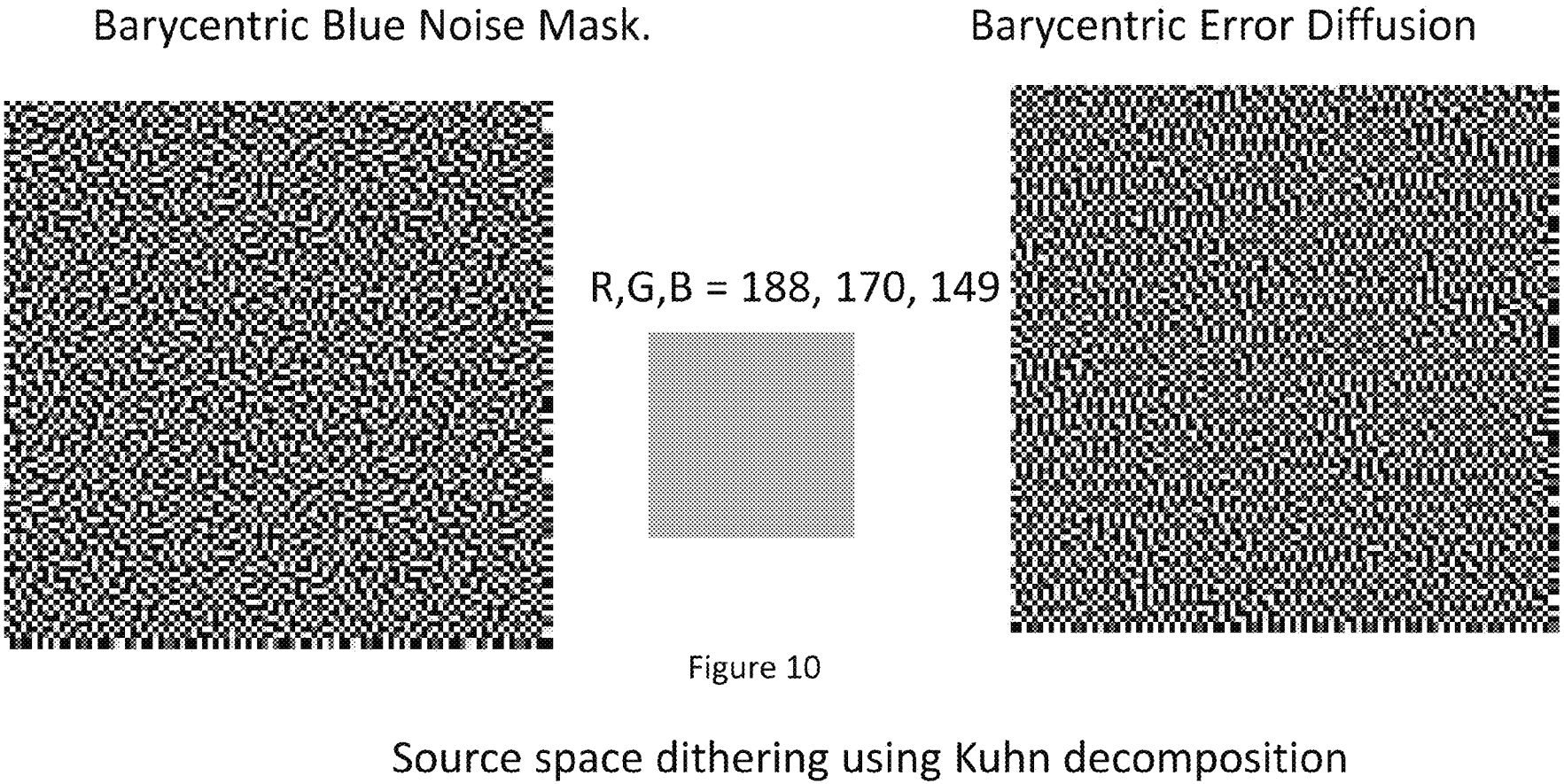

In some embodiments, a multi-color rendering algorithm as illustrated in FIG. 6 may be utilized in accordance with the subject matter disclosed herein. As shown, image data $im_{i,j}$ may be firstly fed through a sharpening filter 602, which may be optional in some embodiments. This sharpening filter 602 may be useful in some cases when a threshold array T(x) or filter is less sharp than an error diffusion system. This sharpening filter 602 may be a simple finite impulse response (FIR) filter, for example 3×3, which may be easily computed. Subsequently, color data may be mapped in a color mapping step 604, and color separation may be generated in a separation generation step 606 by methods commonly available in the art, such as using the Barycentric coordinate method, and this color data may be used to index a CSC_LUT look up table, which can have N-entries per index that gives the desired separation information in the form that is directly needed by the mask based dithering step (e.g., step 612). In some embodiments, this CSC_LUT look up table may be built by combining both a desired color enhancement and/or gamut mapping, and the chosen separation algorithm, and is configured to include a mapping between the input image's color values and the color separation cumulate. In this fashion, the look up table (e.g., CSC_LUT) may be designed to provide the desired separation cumulate information quickly and in the form that is directly needed by the mask based dithering step (e.g., step 612 with the quantizer). Finally, the separation cumulate data 608 is used with a threshold array 610 to generate an output $y_{i,j}$ using a quantizer 612 to generate multiple colors. In some embodiments, the color mapping 604, separation generation 606 and cumulate 608 step may be implemented as a single interpolated CSC_LUT look up table. In this configuration, the separation stage is not done by finding Barycentric coordinates in a tetrahedralization of the multi-primaries, but may be implemented by a look-up table, which allows more flexibility. In addition, output computed by the method illustrated herein is computed completely independently of the other outputs. Furthermore, the threshold array T(x) used herein may be a Blue Noise Mask (BNM), where various BNM designs are presented in FIG. 7-10.

It will be apparent to those skilled in the art that numerous changes and modifications can be made in the specific embodiments of the invention described above without departing from the scope of the invention. Accordingly, the whole of the foregoing description is to be interpreted in an illustrative and not in a limitative sense.

The invention claimed is:

1. A method for driving an electro-optic display having a plurality of display pixels, the method comprising:

receiving an input image;

processing the input image to create color separation cumulate; and dithering the input image by intersecting the color separation cumulate with a dither function.

2. The method of claim 1 wherein the dither function is a threshold array.

3. The method of claim 2 wherein the threshold array is a Blue Noise Mask (BNM).

4. The method of claim 3 wherein the look up table includes a mapping between the input image's color values and the color separation cumulate.

5. The method of claim 4 wherein the sharpening filter is a finite impulse response (FIR) filter.

6. The method of claim 1 wherein the processing the input image step is implemented by a look up table.

7. The method of claim 1 further comprising putting the input image through a sharpening filter before processing the input image.

8. The method of claim 1, wherein the step of processing the input image to create color separation cumulate includes using a Barycentric coordinate method.

9. An electro-optic display configured to carry out the method of claim 1 includes an electrophoretic display.

10. The display according to claim 9 comprising rotating bichromal member, electrochromic or electro-wetting material.

11. The electro-optic display according to claim 9 comprising an electrophoretic material comprising a plurality of electrically charged particles disposed in a fluid and capable of moving through the fluid under the influence of an electric field.

12. The electro-optic display according to claim 11 wherein the electrically charged particles and the fluid are confined within a plurality of capsules or microcells.

13. The electro-optic display according to claim 11 wherein the electrically charged particles and the fluid are present as a plurality of discrete droplets surrounded by a continuous phase comprising a polymeric material.

* * * * *